US010456802B2

(12) United States Patent
Orita et al.

(10) Patent No.: US 10,456,802 B2
(45) Date of Patent: Oct. 29, 2019

(54) ATOMIZING APPARATUS

(71) Applicant: TOSHIBA MITSUBISHI-ELECTRIC INDUSTRIAL SYSTEMS CORPORATION, Tokyo (JP)

(72) Inventors: Hiroyuki Orita, Tokyo (JP); Takahiro Shirahata, Tokyo (JP); Takahiro Hiramatsu, Tokyo (JP); Hiroshi Kobayashi, Tokyo (JP)

(73) Assignee: TOSHIBA MITSUBIHSHI-ELECTRIC INDUSTRIAL SYSTEMS CORPORATION, Tokyo (JP)

( * ) Notice: Subject to any disclaimer, the term of this patent is extended or adjusted under 35 U.S.C. 154(b) by 0 days.

(21) Appl. No.: 14/906,465

(22) PCT Filed: Aug. 8, 2013

(86) PCT No.: PCT/JP2013/071525
§ 371 (c)(1),
(2) Date: Jan. 20, 2016

(87) PCT Pub. No.: WO2015/019468
PCT Pub. Date: Feb. 12, 2015

(65) Prior Publication Data

US 2016/0158788 A1 Jun. 9, 2016

(51) Int. Cl.
*B05B 17/04* (2006.01)
*B05B 17/06* (2006.01)

(52) U.S. Cl.
CPC ..... *B05B 17/06* (2013.01); *B05B 17/0615* (2013.01)

(58) Field of Classification Search
CPC ..... B05B 17/06; B05B 17/0646
(Continued)

(56) References Cited

U.S. PATENT DOCUMENTS 4,410,139 A * 10/1983 Nishikawa ..... B05B 17/0615 239/102.2
4,731,204 A * 3/1988 Noma ..... A47F 3/0447 239/102.2
(Continued)

FOREIGN PATENT DOCUMENTS

CN 202410908 U 9/2012
JP 53-81411 7/1978
(Continued)

OTHER PUBLICATIONS

Office Action dated May 10, 2016 in Japanese Patent Application No. 2015-530624 (with partial English translation).
(Continued)

*Primary Examiner* — Alexander M Valvis
*Assistant Examiner* — Qingzhang Zhou
(74) *Attorney, Agent, or Firm* — Oblon, McClelland, Maier & Neustadt, L.L.P.

(57) ABSTRACT

An atomizing apparatus includes a container that accommodates a solution and a mist generator that forms the solution into a mist. An inner hollow structure is located in the container. The atomizing apparatus supplies a carrier gas into a gas supply space. The atomizing apparatus includes a connecting portion formed therein. The connecting portion connects a hollow of the inner hollow structure and the gas supply space.

13 Claims, 8 Drawing Sheets

(58) Field of Classification Search
USPC ..... 239/4, 8, 11, 102.1, 355, 368, 124, 127, 239/102.2
See application file for complete search history.

(56) References Cited

U.S. PATENT DOCUMENTS

| | | | | | |
|---|---|---|---|---|---|
| 4,776,990 | A * | 10/1988 | Verity | B05B 7/162 | 128/200.16 |
| 5,300,260 | A * | 4/1994 | Keshet | B05B 17/0615 | 239/102.2 |
| 5,908,158 | A * | 6/1999 | Cheiman | B05B 17/0615 | 128/200.16 |
| 6,098,897 | A | 8/2000 | Lockwood | | |
| 6,127,429 | A | 10/2000 | Katusic et al. | | |
| 7,721,729 | B2 * | 5/2010 | Von Hollen | A61M 15/0085 | 128/200.14 |
| 2005/0218241 | A1 * | 10/2005 | Matsuura | B01D 1/0052 | 239/8 |
| 2008/0223953 | A1 * | 9/2008 | Tomono | A01M 1/205 | 239/102.2 |
| 2008/0245362 | A1 * | 10/2008 | Moessis | A61M 15/0085 | 128/200.16 |

FOREIGN PATENT DOCUMENTS

| | | | |
|---|---|---|---|
| JP | 60-162142 | | 8/1985 |
| JP | 6-15757 | | 3/1994 |
| JP | 8-502687 | | 3/1996 |
| JP | 10-286503 | | 10/1998 |
| JP | 11-123356 | | 5/1999 |
| JP | 2008-30026 | A | 2/2008 |
| JP | 2009-28582 | A | 2/2009 |
| JP | 2010-91240 | A | 4/2010 |
| JP | 2011-131140 | A | 7/2011 |
| TW | 392510 | | 6/2000 |
| TW | 200911382 | | 3/2009 |
| WO | 94/08727 | | 4/1994 |

OTHER PUBLICATIONS

Office Action dated Nov. 22, 2016 in Japanese Patent Application No. 2015-530624 (with partial English language translation).
International Search Report dated Sep. 17, 2013 in PCT/JP13/71525 filed Aug. 8, 2013.
Combined Taiwanese Office Action and Search Report dated May 19, 2015 in Taiwanese Application No. 102136727 (With partial English translation) (9 pages).
International Preliminary Report on Patentability and Written Opinion dated Feb. 18, 2016 in PCT/JP2013/071525 (with English Translation).
Combined Chinese Office Action and Search Report dated Jan. 19, 2017 in Patent Application No. 201380078729.4 (with partial English language translation).
Office Action dated Jul. 18, 2017 in Chinese Patent Application No. 201380078729.4 (with English language translation).
Office Action dated Aug. 10, 2017 in Korean Patent Application No. 10-2016-7003197 (with English language translation).
Office Action dated Apr. 11, 2019, in German Patent Application No. 11 2013 007 315.3 (w/English-language translation), 8 pgs.

* cited by examiner

ATOMIZING APPARATUS

TECHNICAL FIELD

The present invention relates to an atomizing apparatus that atomizes a solution into a fine mist (forms a solution into a fine mist) and carries the mist to the outside.

BACKGROUND ART

The technique for atomizing a solution (forming a solution into a mist) with ultrasonic waves has a long history, and thus, various techniques related to atomizing apparatuses are available. For example, the technique for transferring a misted solution by air through the use of fan is available. Apparatuses including such fan are low priced and capable of easily discharging a large amount of mist to the outside.

Alternatively, in some cases, ultrasonic atomizing apparatuses are used in the production of electronic devices. In the field of manufacturing of electronic devices, the ultrasonic atomizing apparatus forms a solution into a mist using ultrasonic waves, and then, discharges the misted solution to the outside with the carrier gas. The solution (mist) carried to the outside is sprayed onto a substrate, so that a thin film for use in an electronic device is deposited onto the substrate.

The prior art documents related to the present invention include Patent Documents 1 to 5.

With the techniques according to Patent Documents 1, 2 and 3, a mist is extracted out of an ultrasonic atomizer by an air sent form a fan. With the techniques according to the Patent Documents 4 and 5, a mist is extracted out of an ultrasonic atomizer by the carrier gas.

PRIOR ART DOCUMENTS

Patent Documents

Patent Document 1: Japanese Patent Application Laid-Open No. 60-162142 (1985)

Patent Document 2: Japanese Patent Application Laid-Open No. 11-123356 (1999)

Patent Document 3: Japanese Patent Application Laid-Open No. 2009-28582

Patent Document 4: Japanese Patent Application Laid-Open No. 2008-30026

Patent Document 5: Japanese Patent Application Laid-Open No. 2011-131140

SUMMARY OF INVENTION

Problems to be Solved by the Invention

In the field of electronic devices, the reaction between moisture in the air and mist or the intrusion of dust in the air causes problems in the film deposition. Thus, the transfer of a misted solution through the use of a fan and the film deposition processing performed with such mist are undesirable in the relevant field.

In view of the above problems, a high-purity gas (or a clean dry air cleared of dust and moisture) is used as the carrier gas for the mist in the above-mentioned ultrasonic atomizing apparatus. To deposit a film by spraying a mist onto a substrate, a larger amount of mist needs to be supplied to the substrate in terms of film deposition efficiency. Such large amount of mist can be supplied by, for example, increasing the amount of carrier gas.

In a case where the amount of the carrier gas for transporting a mist is increased, a burst of mist is sprayed onto the substrate. Consequently, in some cases, the mist adheres to the substrate less efficiently or irregularities in the film deposition are developed due to the turbulence of mist flow. The use of a large amount of high-purity gas increases cost.

Thus, the present invention has an object to provide an atomizing apparatus capable of carrying a large amount of mist (highly-concentrated mist) to the outside with a smaller amount of carrier gas.

Means to Solve the Problems

To achieve the above-mentioned objective, the atomizing apparatus according to the present invention is an atomizing apparatus that forms a solution into a mist. The atomizing apparatus includes a container that accommodates a solution, a mist generator that forms the solution into a mist, and an inner hollow structure that is located in the container and has a hollow inside. The atomizing apparatus further includes a gas supplying unit and a connecting portion. The gas supplying unit is located in the container and supplies a gas into a gas supply space being a space enclosed by an inner surface of the container and an outer surface of the inner hollow structure. The connecting portion connects the hollow of the inner hollow structure and the gas supply space.

Effects of the Invention

The atomizing apparatus according to the present invention includes the inner hollow structure located in the container. The atomizing apparatus supplies a gas into the gas supply space. The atomizing apparatus includes the connecting portion formed therein. The connecting portion connects the hollow of the inner hollow structure and the gas supply space.

Thus, the gas supplied into the gas supply space fills the gas supply space, and then, moves into the hollow of the inner hollow structure through the connecting portion. Even if the gas is output relatively slowly to the gas supply space, the gas is furiously output from the connecting portion. That is, the atomizing apparatus according to the present invention is capable of carrying a large amount of misted solution out of the atomizing apparatus with a smaller amount of gas supplied into the container.

These and other objects, features, aspects and advantages of the present invention will become more apparent from the following detailed description of the present invention when taken in conjunction with the accompanying drawings.

DESCRIPTION OF EMBODIMENT

The present invention relates to an atomizing apparatus that forms a solution into a mist.

In the present invention, the atomizing apparatus includes a container that accommodates a solution and a mist generator that forms the solution into a mist. The atomizing apparatus according to the preset invention further includes an inner hollow structure that is located in the container in such a manner that the inner hollow structure is inserted in the container and has a hollow inside. The inner hollow structure is located in the container, and accordingly, two spaces are formed in the container.

That is, the inside of the container is divided into a hollow (mist generation space) of the inner hollow structure and a space (gas supply space) enclosed by the inner surface of the container and the outer surface of the inner hollow structure. These two spaces (the mist generation space and the gas supply space) are connected through a connecting portion being a narrow passage.

The atomizing apparatus according to the present invention further includes a gas supplying unit located in the container. The gas supplying unit supplies the gas supply space with gas.

The mist atomized by the atomizing apparatus is output to the outside of the atomizing apparatus and used in other apparatuses as, for example, a material in the film deposition processing for electronic devices (such as FPDs, solar cells, LEDs, and touch panels).

The following describes the atomizing apparatus according to the present invention in detail with reference to the drawings.

Embodiment

Figure 1:
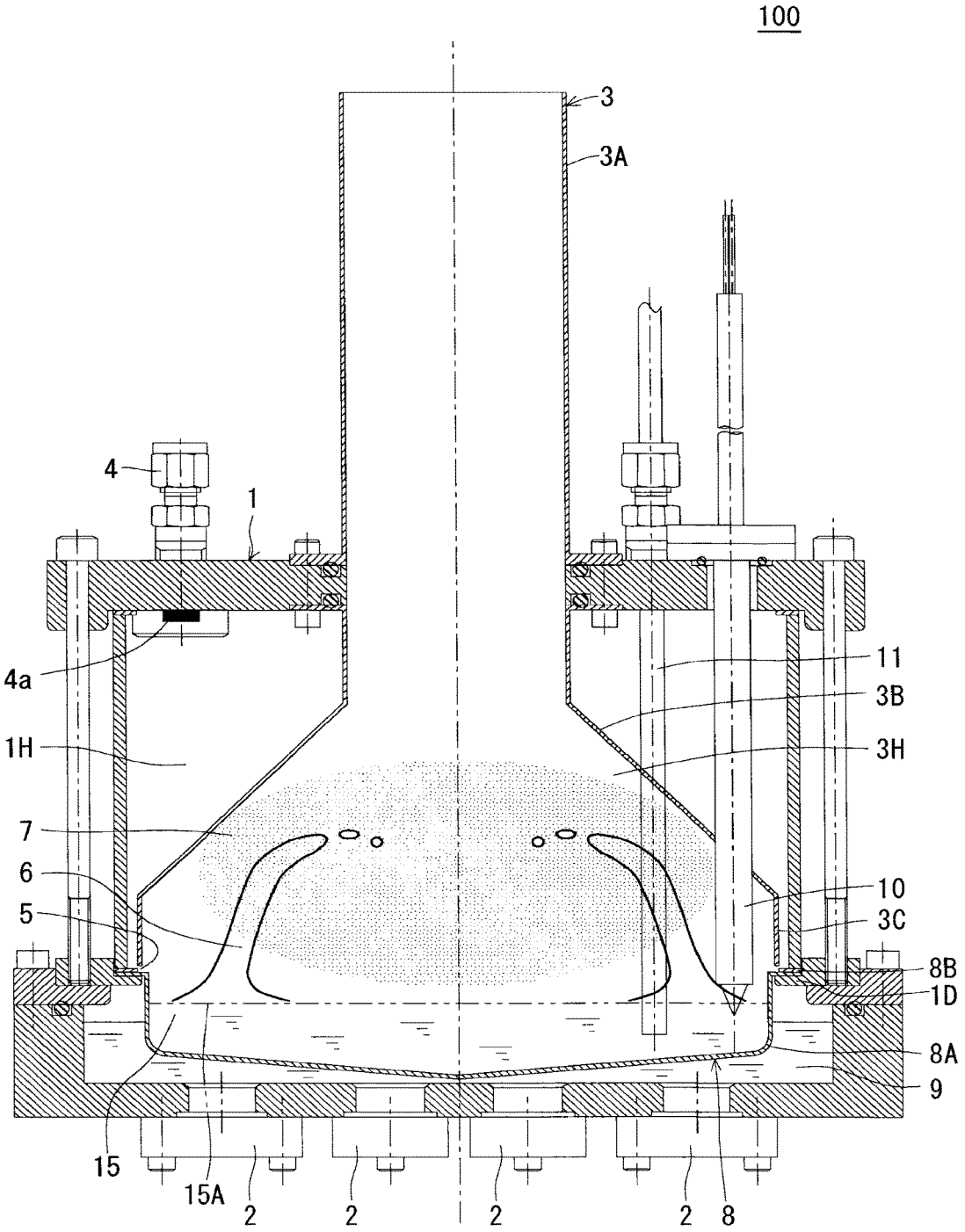
FIG. 1 A cross-sectional view illustrating the configuration of an atomizing apparatus 100 according to an embodiment.

FIG. 1 is a cross-sectional view illustrating the cross-sectional configuration of an atomizing apparatus 100 according to the present embodiment.

As shown in FIG. 1, the atomizing apparatus 100 includes a container 1, a mist generator 2, an inner hollow structure 3, and a gas supplying unit 4. The atomizing apparatus 100 illustrated in FIG. 1 further includes a separator 8, a liquid surface position detection sensor 10, and a solution supplying unit 11.

The container 1 may have any shape that has a space formed therein. In the atomizing apparatus 100 illustrated in FIG. 1, the container 1 is substantially cylindrical and a space surrounded by the inner circumferential side surface is formed in the container 1. As described below, a solution is accommodated in the container 1.

In this preferred embodiment, the mist generator 2 is an ultrasonic oscillator 2 that applies ultrasonic waves to the solution in the container 1 to form the solution into a mist (atomize the solution). The ultrasonic oscillator 2 is located on the bottom surface of the container 1. One ultrasonic oscillator 2 may be provided. Alternatively, two or more ultrasonic oscillators 2 may be provided. With reference to the configuration example in FIG. 1, a plurality of ultrasonic oscillators 2 are located on the bottom surface of the container 1.

The inner hollow structure 3 is the structure that has a hollow inside. The upper surface portion of the container 1 has an opening formed therein. As shown in FIG. 1, the inner hollow structure 3 is located in the container 1 in such a manner that the inner hollow structure 3 is inserted in the container 1 through the opening. With the inner hollow structure 3 inserted in the opening, the portion between the inner hollow structure 3 and the container 1 is airtight. That is, the portion between the inner hollow structure 3 and the container 1 is sealed.

The inner hollow structure 3 may have any shape that has a hollow formed inside. With reference to the configuration example in FIG. 1, the inner hollow structure 3 is flask-shaped and does not have a bottom surface. To be more specific, the inner hollow structure 3 shown in FIG. 1 includes a tubular portion 3A, a truncated cone portion 3B, and a cylindrical portion 3C.

The tubular portion 3A is the duct portion having a cylindrical shape. The tubular portion 3A extends from the outside of the container 1 to the inside of the container 1 in such a manner that the tubular portion 3A is inserted from the upper surface of the container 1. To be more specific, the tubular portion 3A is divided into an upper tubular portion located outside the container 1 and a lower tubular portion located in the container 1. The upper tubular portion is fixed from the outer side of the upper surface of the container 1 and the lower tubular portion is fixed from the inner side of the upper surface of the container 1. While being fixed, the upper tubular portion and the lower tubular portion are in communication with each other through the opening provided in the upper surface of the container 1. One end of the tubular portion 3A is connected to, for example, the inside of a thin film deposition apparatus located outside the container 1. The other end of the tubular portion 3A is connected to the upper end side of the truncated cone portion 3B in the container 1.

The external appearance (the side wall surface) of the truncated cone portion 3B has a truncated cone shape. The truncated cone portion 3B has a hollow formed inside. The truncated cone portion 3B has an open upper surface and an open undersurface (or equivalently, does not have an upper surface and an undersurface that enclose the hollow formed inside). The truncated cone portion 3B is located in the container 1. As mentioned above, the upper end side of the truncated cone portion 3B is in connection (communication) with the other end of the tubular portion 3A and the lower end part side of the truncated cone portion 3B is connected to the upper end side of the cylindrical portion 3C.

The truncated cone portion 3B has a cross-sectional shape that broadens from the upper end side to the lower end side. Thus, the side wall of the truncated corn portion 3B on the upper end side has the smallest diameter (equal to the diameter of the tubular portion 3A). The side wall of the truncated corn portion 3B on the lower end side has the largest diameter (equal to the diameter of the cylindrical portion 3C). The diameter of the side wall of the truncated corn portion 3B increases smoothly from the upper end side to the lower end side.

The cylindrical portion 3C is the portion having a cylindrical shape. The cylindrical portion 3C has a height smaller than the height of the truncated corn portion 3B. As mentioned above, the upper end side of the cylindrical portion 3C is in connection (communication) with the lower end side of the truncated corn portion 3B and the lower end side of the cylindrical portion 3C faces the bottom surface of the container 1. With reference to the configuration example in FIG. 1, the cylindrical portion 3C is left open on the lower end side (or equivalently, does not have a bottom surface).

With reference to the configuration example in FIG. 1, the central axis of the inner hollow structure 3 extending from the tubular portion 3A through the truncated corn portion 3B toward the tubular portion 3C agrees with the central axis of the cylindrical shape of the container 1. The inner hollow structure 3 may have an integrated structure. Alternatively, as shown in FIG. 1, the inner hollow structure 3 may be a combination of the members including the upper tubular portion being a part of the tubular portion 3A, the lower tubular portion being the remaining part of the tubular portion 3A, the truncated corn portion 3B, and the tubular portion 3C. With reference to the configuration example in FIG. 1, the lower end part of the upper tubular portion is connected to the outer upper surface of the container 1, the upper end part of the lower tubular portion is connected to the inner upper surface of the container 1, and the member including the truncated corn portion 3B and the cylindrical portion 3C is connected to the lower end part of the lower tubular portion, providing the inner hollow structure 3 formed of the plurality of members.

The inner hollow structure 3 having the above-mentioned shape is located in the container 1 in such a manner that the inner hollow structure 3 is inserted in the container 1, and thus, the inside of the container 1 is divided into the two spaces. That is, the inside of the container 1 is partitioned into the hollow portion (the space that is enclosed by the inner side surface of the inner hollow structure 3 and is hereinafter referred to as "mist generation space 3H") formed in the inner hollow structure 3 and the space (hereinafter referred to as "gas supply space 1H") defined by the inner surface of the container 1 and the outer side surface of the inner hollow structure 3.

A connecting portion 5 being the clearance that connects the mist generation space 3H and the gas supply space 1H is formed. With reference to the configuration example in FIG. 1, the connecting portion 5 is located on the lower end side of the inner hollow structure 3. That is, with reference to the configuration example in FIG. 1, the connecting portion 5 is defined by the lower end portion of the inner hollow structure 3 and a part of the upper surface of the separator 8 which will be described later. The connecting portion 5 has an opening dimension of 0.1 mm to 10 mm.

Figure 2:
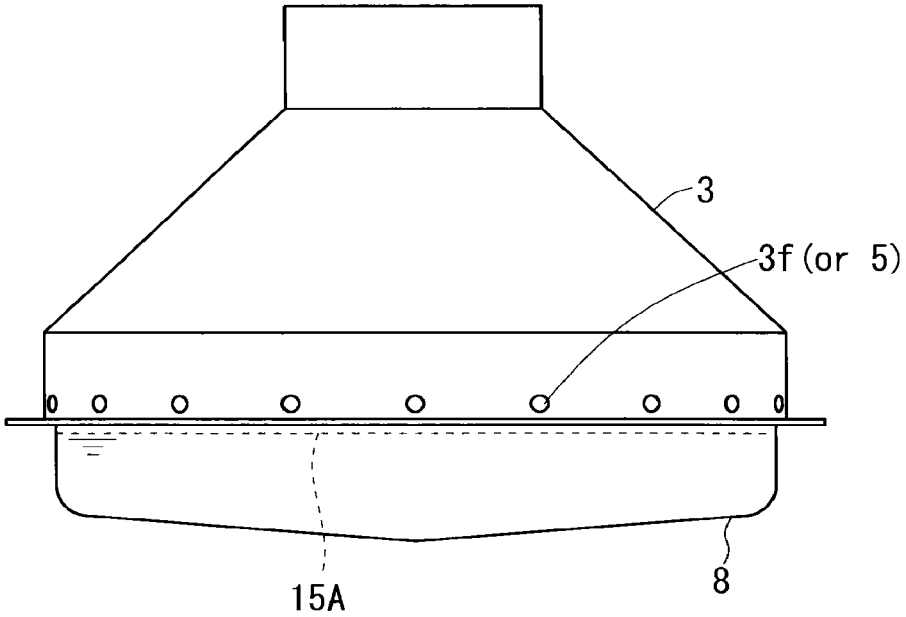
FIG. 2 A side view illustrating a configuration example of a connecting portion 5 that connects a mist generation space 3H and a gas supply space 1H.

The connecting portion 5 that connects the mist generation space 3H and the gas supply space 1H may have various configurations (see FIGS. 2 to 5 being side views). The connecting portion 5 may be formed by drilling small holes 3*f* (having an opening dimension of about 0.1 mm to 10 mm) in the side surface of the inner hollow structure 3 (FIG. 2). Unlike the configuration example in FIG. 2, such configuration may involve the formation of the bottom surface of the inner hollow structure 3, so that the bottom surface functions as the separator 8 which will be described later. The holes 3*f*, which may be provided in the side surface of the inner hollow structure 3, are preferably provided on the side closer to the bottom surface of the container 1. The holes 3*f* may be drilled discretely and evenly in the side surface of the inner hollow structure 3. The connecting portion 5 may be formed by drilling an annular slit in the side surface of the inner hollow structure 3.

Figure 3:
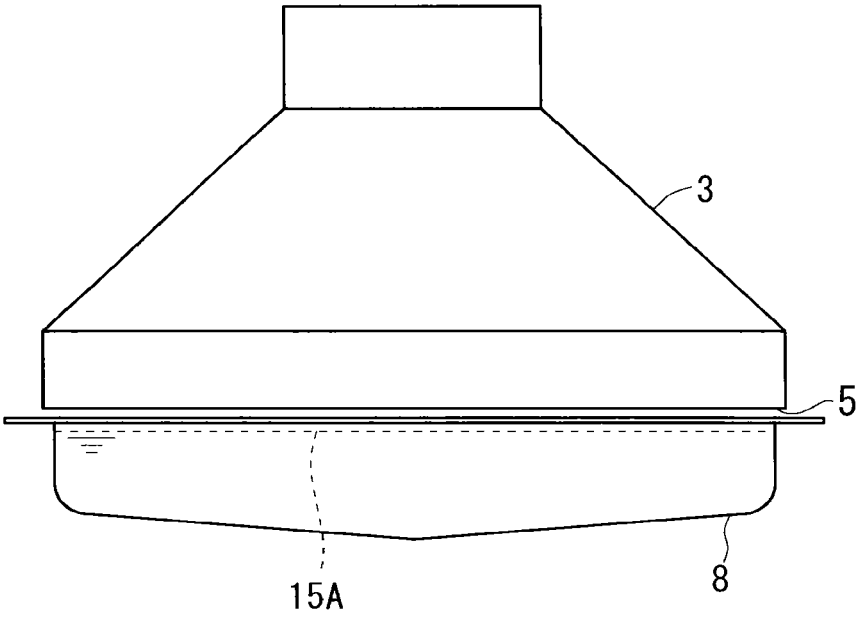
FIG. 3 A side view illustrating a configuration example of the connecting portion 5 that connects the mist generation space 3H and the gas supply space 1H.
Figure 4:
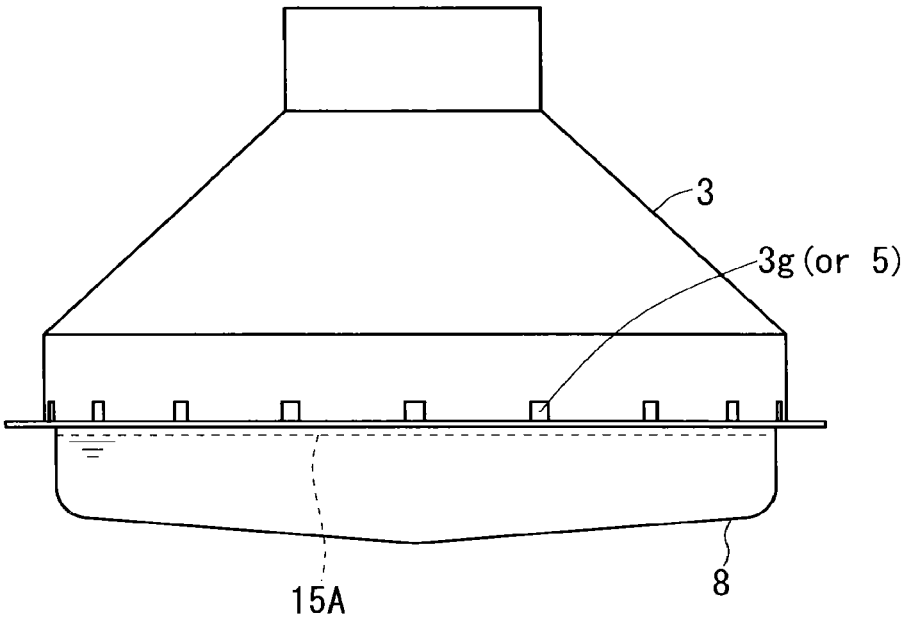
FIG. 4 A side view illustrating a configuration example of the connecting portion 5 that connects the mist generation space 3H and the gas supply space 1H.
Figure 5:
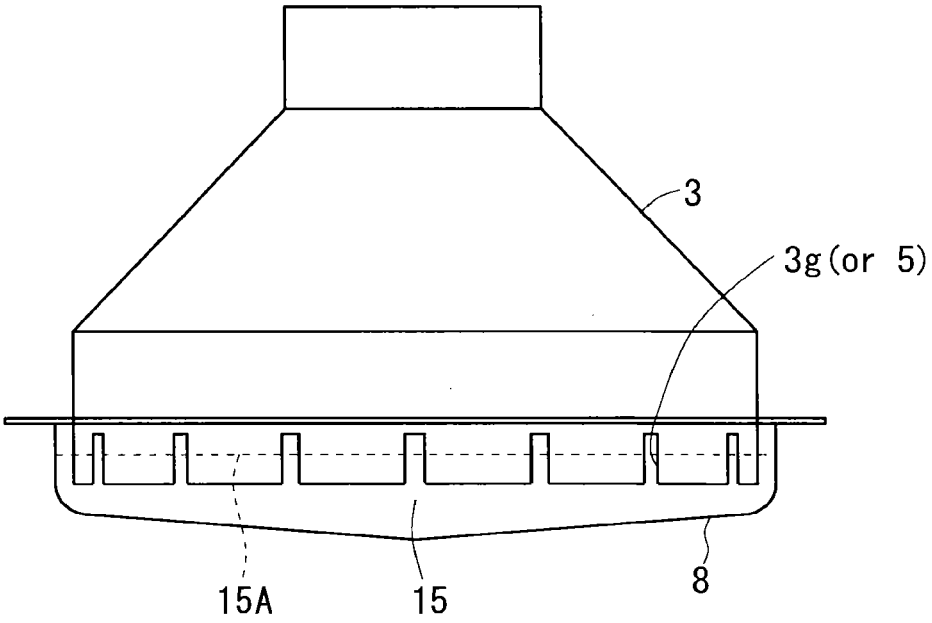
FIG. 5 A side view illustrating a configuration example of the connecting portion 5 that connects the mist generation space 3H and the gas supply space 1H.

With reference to the configuration example in FIG. 1, as shown in the side view in FIG. 3, the connecting portion 5 being an annular slit is formed between the lower end portion of the inner hollow structure 3 and the upper end portion of the separator 8. As shown in FIGS. 4 and 5, the connecting portion 5 may be formed by drilling small cutouts 3*g* (having an opening dimension of 0.1 mm to 10 mm) in the side surface of the lower end portion of the inner hollow structure 3. With reference to the configuration in FIG. 4, the lower end portion of the inner hollow structure 3 is located above a liquid surface 15A. With reference to the configuration in FIG. 5, the lower end portion of the inner hollow structure 3 is immersed in a solution 15. A part of the cutouts 3*g* is located in the solution 15. The reaming part of the cutouts 3*g* is located above the liquid surface 15A (the remaining part of the cutouts 3*g* functions as the connecting portion 5). The cutouts 3*g* in FIGS. 4 and 5 are formed discretely and evenly in the side surface of the lower end portion of the inner hollow structure 3.

Although the connecting portion 5 may have any given shape and be located at any given position, the connecting portion 5 is preferably located above the liquid surface 15A of the solution 15 and is preferably located in a position closer to the liquid surface 15A.

With reference to the configuration example in FIG. 1, as is evident from the shape of the inner hollow structure 3 and the shape of the container 1, the gas supply space 1H has the largest width on the upper portion side of the container 1 and gradually narrows to the lower side of the container 1. That is, the gas supply space 1H enclosed by the outer side surface of the tubular portion 3A and the inner side surface of the container 1 has the largest width while the gas supply space 1H enclosed by the outer side surface of the cylindrical portion 3C and the inner side surface of the container 1 has the smallest width.

The gas supplying unit 4 is located on the upper surface of the container 1. The gas supplying unit 4 supplies a carrier gas that carries a solution formed into a mist by the ultrasonic oscillators 2 to the outside through the tubular portion 3A of the inner hollow structure 3. The carrier gas is, for example, a highly-concentrated inert gas. As shown in FIG. 1, the gas supplying unit 4 includes a supply port 4*a*. Thus, the carrier gas is supplied into the gas supply space 1H of the container 1 from the supply port 4*a* located in the container 1.

The carrier gas supplied by the gas supplying unit 4 is supplied into the gas supply space 1H. The carrier gas fills the gas supply space 1H, and then, is introduced to the mist generation space 3H through the connecting portion 5. After filling the gas supply space 1H, the carrier gas is supplied into the mist generation space 3H through the connecting portion 5 that is narrow. Consequently, the gas speed of the carrier gas output from the connecting portion 5 is faster than the gas speed of the carrier gas output from the supply port 4*a*. In other words, even if the carrier gas is slowly output from the supply port 4*a*, the carrier gas bursts in the mist generation space 3H from the connecting portion 5. The following configuration is desirably applied to emphasize such flow of the carrier gas.

For example, the opening area of the opening of the connecting portion 5 is desirably smaller than the opening area of the supply port 4*a* of the gas supplying unit 4. The dimension between the inner wall surface of the container 1 and the outer wall surface of the inner hollow structure 3 in the gas supply space 1H around the connecting portion 5 is desirably smaller than the dimension between the inner wall surface of the container 1 and the outer wall surface of the inner hollow structure 3 in the gas supply space 1H around the gas supplying unit 4 (the supply port 4*a*). It is desirable that the supply port 4*a* of the gas supplying unit 4 does not directly face the gas supply space 1H side facing the connecting portion 5. For example, with reference to the configuration example in FIG. 1, the supply port 4*a* of the gas supplying unit 4 lies in the front-rear direction of the sheet of FIG. 1, and thus, is not directed toward the gas supply space 1H facing the connecting portion 5 (the gas supply space 1H in the region enclosed by the inner wall of the container 1 and the outer wall of the cylindrical portion 3C of the inner hollow structure 3).

The atomizing apparatus 100 according to the present embodiment includes the separator 8 located between the bottom surface of the container 1 and the lower end portion side of the inner hollow structure 3. As shown in FIG. 1, the separator 8 is cup-shaped. That is, the separator 8 includes a recessed portion 8A and a flat edge portion 8B connected to the upper end part of the recessed portion 8A.

As shown in FIG. 1, the flat edge portion 8B of the separator 8 is the annular edge portion extending from the upper end part of the recessed portion 8A toward the inner wall of the container 1. The undersurface of the flat edge portion 8B is fixed to a projecting portion 1D of the container 1 located in the container 1. With reference to the configuration example in FIG. 1, the connecting portion 5 is formed between the flat edge portion 8B and the lower end portion of the inner hollow structure 3.

As shown in FIG. 1, the bottom surface of the recessed portion 8A of the separator 8 gently slopes from the side surface part of the recessed portion 8A toward the center of the recessed portion 8A. To be more specific, the dimension between the bottom surface of the recessed portion 8A and the bottom surface of the container 1 gradually decreases form the side surface of the recessed portion 8A toward the central part of the recessed portion 8A.

The space formed between the bottom surface of the container 1 and the bottom surface of the separator 8 is filed with an ultrasonic transmitting medium 9. The ultrasonic wave transmitting medium 9 has the function of transmitting, to the separator 8, ultrasonic oscillation generated by the ultrasonic oscillators 2 located on the bottom surface of the container 1. Thus, to transmit the oscillation energy to the separator 8, the ultrasonic wave transmitting medium 9 is accommodated in the space formed between the bottom surface of the container 1 and the bottom surface of the separator 8. To effectively transmit the ultrasonic oscillation to the separator 8, the ultrasonic wave transmitting medium 9 is preferably a liquid, such as water.

The solution 15 to be formed into a mist is accommodated on the bottom surface of the recessed portion 8A of the separator 8. The liquid surface 15A of the solution 15 is below the position in which the connecting portion 5 is located (see FIG. 1).

With reference to the configuration example in FIG. 1, the separator 8 and the ultrasonic wave transmitting medium 9 may be omitted. If this is the case, the solution 15 is accommodated directly on the bottom surface of the container 1. In this case as well, the liquid surface 15A of the solution 15 is below the position in which the connecting portion 5 is located.

In a case where the solution 15 to be formed into a mist is, for example, a liquid with strong alkalinity or acidity, which would adversely affect the ultrasonic oscillators 2 located on the bottom surface of the container 1, the separator 8 and the ultrasonic wave transmitting medium 9 are desirably included as shown in FIG. 1. If this is the case, the separator 8 is made of a material free from (less susceptible to) the effect of the solution 15 with strong alkalinity or acidity.

The atomizing apparatus 100 according to the present embodiment includes the liquid surface position detection sensor 10 and the solution supplying unit 11.

The solution supplying unit 11 penetrates the container 1 and the inner hollow structure 3 and includes a solution supply port located on the bottom surface side of the container 1. A tank filled with the solution 15 is provided outside the atomizing apparatus 100. The solution supplying unit 11 supplies the solution 15 from the tank to the separator 8 (or the bottom surface of the container 1 in a case where the separator 8 is not provided).

In a case where the solution 15 is formed into a mist by the ultrasonic oscillators 2, the efficiency of mist generation is maximized while the liquid surface 15A is located at a certain position (the solution 15 has a certain depth). Thus, with reference to the configuration in FIG. 1, in addition to the solution supplying unit 11, the liquid surface position detection sensor 10 is provided such that the liquid surface 15A is kept at the position for maximizing the efficiency of mist generation.

The liquid surface position detection sensor 10 is the sensor capable of detecting the level position of the liquid surface of the solution 15. The liquid surface position detection sensor 10 penetrates the container 1 and the inner hollow structure 3. A part of the sensor 10 is immersed in the solution 15. The liquid surface position detection sensor 10 detects the position of the liquid surface 15A of the solution 15. When the solution 15 is formed into a mist and carried out of the atomizing apparatus 100, the liquid surface 15A of the solution 15 declines. Thus, the solution supplying unit 11 replenishes (supplies) the container 1 with the solution 15 such that the detection result obtained by the liquid surface position detection sensor 10 reaches the position for maximizing the above-mentioned efficiency of forming the solution 15 into a mist.

That is, the liquid surface position detection sensor 10 and the solution supplying unit 11 are provided, so that the liquid surface 15A of the solution 15 is kept at the level position for maximizing the efficiency of mist generation. The position of the liquid surface 15A for maximizing the efficiency of mist generation has been already found by, for example, experiments and is set, in advance, as the setting value for the atomizing apparatus 100. The atomizing apparatus 100 adjusts the supply of solution 15 from the solution supplying unit 11 on the basis of the setting value and the detection result obtained by the liquid surface position detection sensor 10.

In some cases, during the operation of atomizing the solution 15, a liquid column 6 rises from the liquid surface 15A and thus the liquid surface 15A waves, making it difficult to detect the accurate position of the liquid surface. Thus, a cover is desirably located around the liquid surface position detection sensor 10 to prevent the liquid surface 15A around the liquid surface position detection sensor 10 from waving.

The solution 15 in the container 1 is finely atomized by the ultrasonic oscillators 2, and then, a misted solution 7 fills the mist generation space 3H in the inner hollow structure 3.

The misted solution 7 is carried by the carrier gas output from the connecting portion 5 through the tubular portion 3A of the inner hollow structure 3, and then, is output to the outside of the atomizing apparatus 100.

With reference to the configuration example in FIG. 1, the ultrasonic oscillators 2 applies ultrasonic oscillation to the solution 15 through the ultrasonic transmitting medium 9 and the separator 8. Consequently, as shown in FIG. 1, the liquid column 6 rises from the liquid surface 15A, and then, the solution 15 is transformed into liquid particles and a mist. If the liquid column 6 rises in the direction vertical to the liquid surface and this liquid column 6 falls down onto the oscillators 2, the efficiency of mist generation declines.

Figure 6:
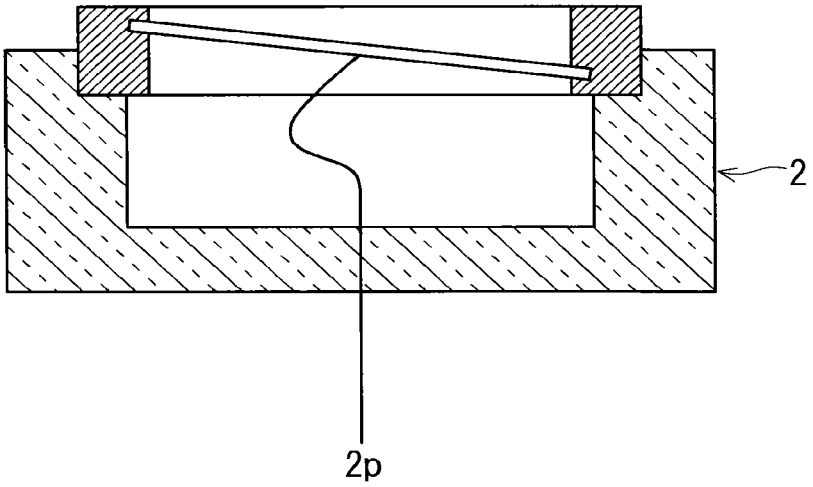
FIG. 6 A schematic cross-sectional view illustrating the state in which a vibration plane (vibration plate) 2*p* of an ultrasonic oscillator 2 is inclined.

Thus, the oscillation planes (piezoelectric elements) of the ultrasonic oscillators 2 are inclined (see the cross-sectional view in FIG. 6). FIG. 6 illustrates the schematic configuration of the ultrasonic oscillator 2. As shown in FIG. 6, an oscillation plane (oscillation plate) 2*p* is inclined. That is, the liquid surface 15A and the oscillation plane (oscillation plate) 2*p* are not parallel with each other. In other words, the ultrasonic oscillator 2 is located in the container 1 in such a manner that the oscillation energy generated by the ultrasonic oscillator 2 is propagated in a direction that is not vertical to the liquid surface 15A.

The efficiency of mist generation is improved by increasing the number of ultrasonic oscillators 2. In a case where the plurality of ultrasonic oscillators 2 are located on the bottom surface of the container 1, they are desirably arranged in the following manner in order to control the decline in the efficiency of mist generation.

As mentioned above, the oscillation planes of the individual ultrasonic oscillators 2 are inclined to the liquid surface 15A of the solution 15 to prevent the liquid columns 6 from rising in the direction vertical to the liquid surface 15A. It is desirable that each of the ultrasonic oscillators 2 is not located in the lower position onto which liquid droplets from the liquid column 6 of the solution 15 formed by another one of the ultrasonic oscillators 2 fall. Thus, droplets from the individual liquid columns 6 are mainly prevented from falling onto the spots above any of the ultrasonic oscillators 2, whereby the decline in the efficiency of mist generation can be controlled.

Figure 7:
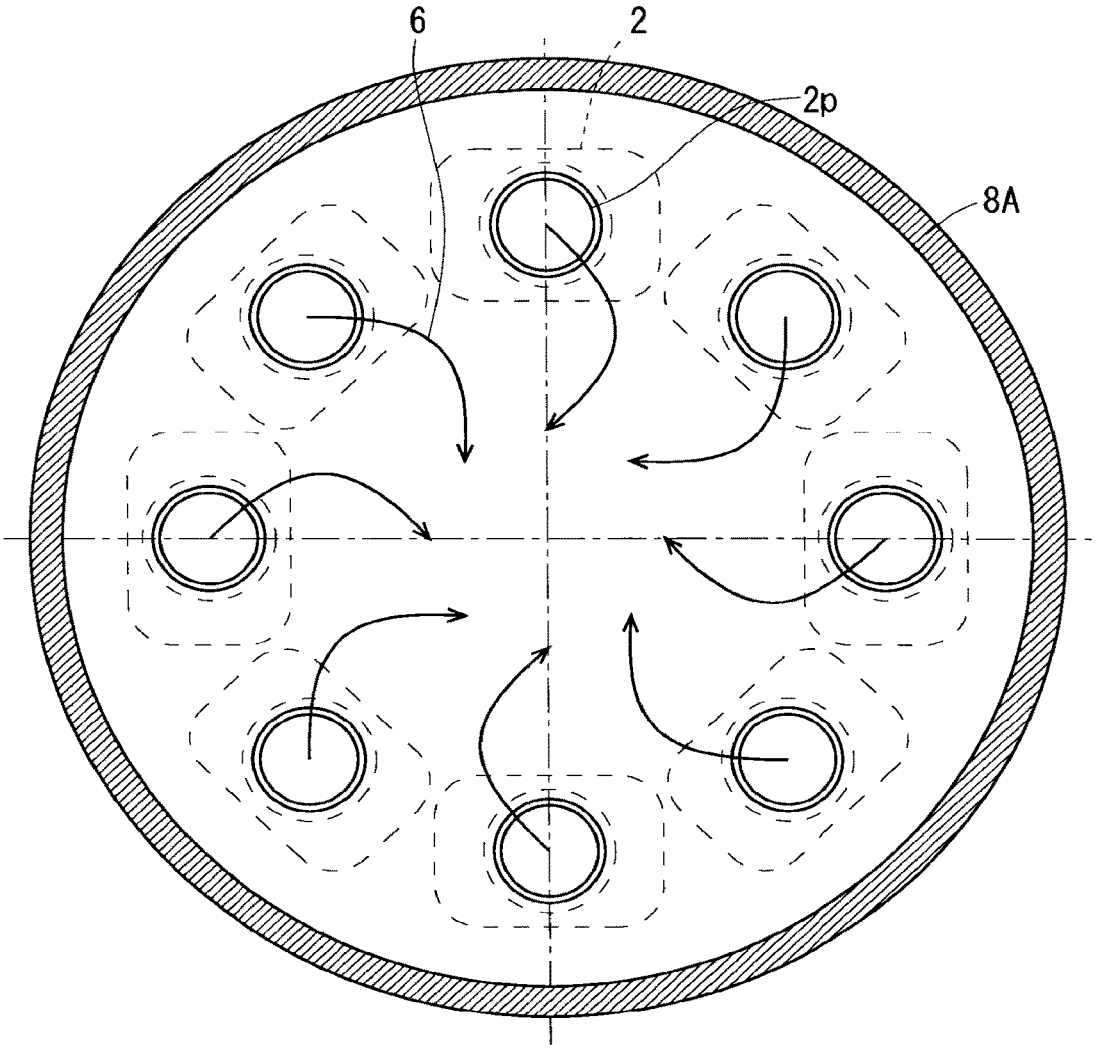
FIG. 7 A plan view illustrating a plurality of ultrasonic oscillators 2 located in an annular shape.

In a case where the plurality of ultrasonic oscillators 2 are provided, the individual ultrasonic oscillators 2 are arranged, for example, as described below to control the decline in the efficiency of mist generation. That is, below the solution 15, the individual ultrasonic oscillators 2 are evenly located on the bottom surface of the container 1 in an annular shape. The diameter of the annular shape is preferably increased to a maximum extent. For example, as shown in the plan view in FIG. 7 that illustrates the arrangement of the ultrasonic oscillators 2, it is desirable that the individual ultrasonic oscillators 2 are located discretely in an annular shape along the outer periphery of the recessed portion 8A of the separator 8. The oscillation planes 2*p* of the individual ultrasonic oscillators 2 are inclined toward the center of the annular shape (or equivalently, the center of the container 1). The arrows shown in FIG. 7 indicate the liquid columns 6.

The container 1 is formed of a combination of a plurality of members. Some members penetrate through the container 1 or are located in the container 1. For example, the container 1 having such configuration is sealed such that the airtightness in the container 1 is ensured.

Next, the operation of the atomizing apparatus 100 according to the present embodiment is described.

Firstly, the solution supplying unit 11 supplies the solution 15 into the separator 8 from the outside such that the detection result obtained by the liquid surface position detection sensor 10 reaches the predetermined position of the liquid surface that has been set in advance. Then, the detection result obtained by the liquid surface position detection sensor 10 reaches the predetermined position of the liquid surface. Subsequently, the atomizing apparatus 100 supplies a high-frequency power to the ultrasonic oscillators 2. This causes the oscillation planes of the ultrasonic oscillators 2 to oscillate.

The oscillation energy generated by the oscillation of the oscillation planes are propagated to the solution 15 through the ultrasonic wave transmitting medium 9 and the separator 8. Then, the oscillation energy reaches the liquid surface 15A of the solution 15. The ultrasonic waves are not easily propagated through gas. Thus, the oscillation energy that has reached the liquid surface 15A raises the liquid surface 15A of the solution 15, thereby forming the liquid columns 6. The tip portions of the liquid columns 6 are pulled and broken into fine pieces, generating a mist in the form of a large number of fine particles (see the misted solution 7 in FIG. 1).

While the mist generation space 3H is filled with the misted solution 7, meanwhile, the gas supplying unit 4 supplies the carrier gas into the gas supply space 1H from the outside. After filling the gas supply space 1H, the carrier gas supplied from the supply port 4*a* moves to the mist generation space 3H through the connecting portion 5 being a narrow opening.

After filling the gas supply space 1H, the carrier gas is output to the mist generation space 3H though the connecting portion 5 that is narrow. Thus, even if the carrier gas is output relatively slowly from the supply port 4*a*, the carrier gas is output furiously from the connecting portion 5.

With reference to FIG. 1, the carrier gas output from the connecting portion 5 raises, from below upward, the misted solution 7 filling the mist generation space 3H. The misted solution 7 is carried by the carrier gas through the tubular portion 3A of the inner hollow structure 3, and then, is output to the outside of the atomizing apparatus 100.

As mentioned above, the atomizing apparatus 100 according to the present embodiment includes the inner hollow structure located in the container 1 in such a manner that the inner hollow structure is inserted in the container 1. Thus, the gas supply space 1H and the mist generation space 3H are formed in the container 1, and the gas supply space 1H and the mist generation space 3H are connected through the connecting portion 5 that is narrow.

Thus, the carrier gas supplied into the gas supply space 1H fills the gas supply space 1H, and then, moves into the mist generation space 3H through the connecting portion 5 that is narrow. Thus, even if the carrier gas is output relatively slowly from the supply port 4*a*, the carrier gas is output furiously from the connecting portion 5. That is, for the atomizing apparatus 100 according to the present embodiment, a large amount of the misted solution 7 (a highly-concentrated mist) can be carried out of the atomizing apparatus 100 by a smaller amount of carrier gas supplied into the container 1.

It has been impossible to output a large amount of mist to the outside with a smaller amount of carrier gas. Meanwhile, the atomizing apparatus 100 according to the present embodiment is capable of efficiently outputting the misted solution 7 out of the atomizing apparatus 100.

An experiment was carried out to verify the effects of the atomizing apparatus 100 according to the present embodiment. The results of this experiment are shown in FIG. 8.

Figure 8:
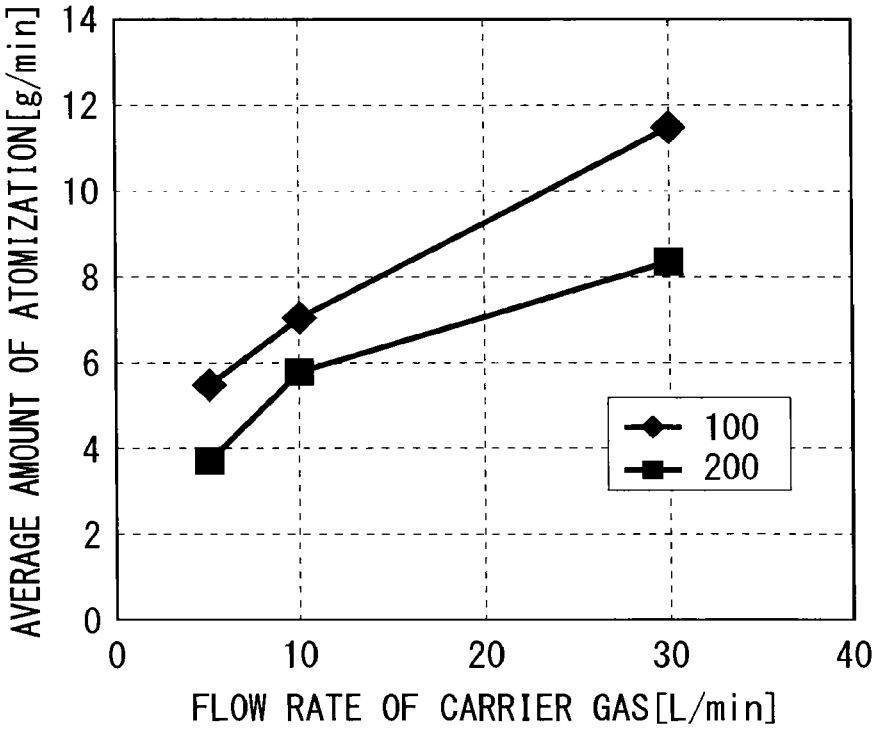
FIG. 8 A view illustrating experimental data for describing effects of the atomizing apparatus 100 according to the embodiment.

FIG. 8 shows the experimental results indicating the relation between the flow rate of the carrier gas and the amount of the misted solution 7 (hereinafter referred to as mist). The vertical axis in FIG. 8 indicates the average amount of atomization (g (gram)/min (minute)) and the horizontal axis in FIG. 8 indicates the flow rate of carrier gas (L (liter)/min (minute)). With reference to FIG. 8, the black rhombus marks indicate the results involved in the atomizing apparatus 100 and the black square marks indicate the results involved in a comparison target atomizing apparatus 200.

Figure 9:
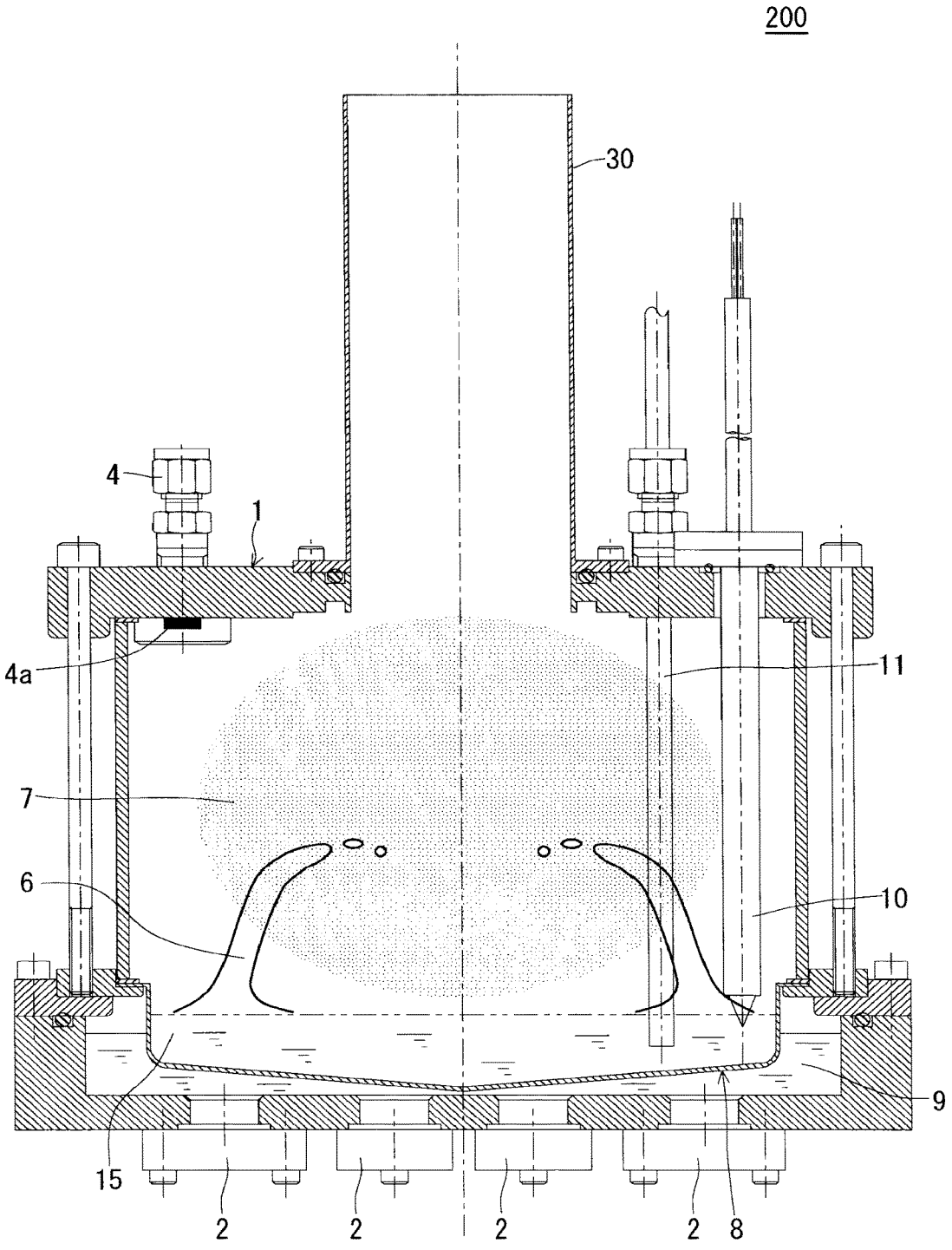
FIG. 9 A cross-sectional view illustrating the configuration of a comparison target atomizing apparatus 200.

FIG. 9 is a cross-sectional view illustrating the configuration of the comparison target atomizing apparatus 200. The comparison target atomizing apparatus 200 does not include the inner hollow structure 3 included in the atomizing apparatus 100. The comparison target atomizing apparatus 200 includes a tubular portion 30 for carrying the misted solution 7 to the outside. The tubular portion 30 is located on the upper portion of the container 1 so as to be connected to the inside of the container 1 of the comparison target atomizing apparatus 200 (see FIG. 9).

The atomizing apparatus 100 and the comparison target atomizing apparatus 200 have the same configuration except for the above-mentioned configuration, and operate in a similar manner.

In the experiment indicated in FIG. 8, the flow rate of the carrier gas was changed, and then, changes (the amount of decrease) in the weight of the external solution tank within a predetermined period of time were measured for each flow rate of the carrier gas. In the atomizing apparatuses 100 and 200, the position of the liquid surface of the solution 15 is kept constant by the liquid surface position detection sensor 10. Thus, changes in the weight of the external solution tank can be regarded as the amount of atomization. The value obtained by dividing the change in the weight of the external solution tank by the predetermined period of time mentioned above is the average amount of atomization (g/min) indicated by the vertical axis in FIG. 8.

As is evident from the experimental results indicated in FIG. 8, the atomizing apparatus 100 according to the present embodiment is capable of carrying the misted solution 7 to the outside with a high degree of efficiency increased by 20% or more compared to that of the comparison target atomizing apparatus 200.

For the atomizing apparatus 100 according to the present embodiment, a part of the connecting portion 5 may be defined by the end portion of the inner hollow structure 3. In such configuration, the connecting portion 5 is, as shown in FIG. 1, the clearance between the lower end portion of the inner hollow structure 3 and the flat edge portion 8B of the separator 8.

With such configuration of the connecting portion 5, the carrier gas passing through the connecting portion 5 is output into the mist generation space 3H from the position further below the misted solution 7. Thus, the atomizing apparatus 100 can carry the misted solution 7 to the outside more efficiently.

For the atomizing apparatus 100 according to the present embodiment, the opening of the connecting portion 5 may have an opening area that is smaller than the opening area of the supply port 4*a* of the gas supplying unit 4. Alternatively, for the atomizing apparatus 100, the dimension between the inner wall surface of the container 1 and the outer wall surface of the inner hollow structure 3 in the gas supply space 1H around the connecting portion 5 may be smaller than the dimension between the inner wall surface of the container 1 and the outer wall surface of the inner hollow structure 3 in the gas supply space 1H around the gas supplying unit 4. Still alternatively, the supply port 4*a* of the gas supplying unit 4 may not directly face the gas supply space 1H facing the connecting portion 5. These configurations may be optionally combined.

For the atomizing apparatus 100 having the above-mentioned configuration, even if the carrier gas is slowly output from the supply port 4*a*, the carrier gas can be supplied into the mist generation space 3H more furiously from the connecting portion 5. That is, a larger amount of the misted solution 7 can be output to the outside with a smaller amount of carrier gas.

For the atomizing apparatus 100 according to the present embodiment, the ultrasonic oscillators 2 are located on the bottom surface of the container 1. The separator 8 may be located between the bottom surface of the container 1 and the end portion side of the inner hollow structure 3. In a case where the separator 8 is provided, the portion between the container 1 and the separator 8 is filled with the ultrasonic wave transmitting medium 9 and the solution 15 which is to be formed into a mist is supplied to the upper surface of the separator 8.

With this configuration of including the separator 8 and the ultrasonic wave transmitting medium 9, even if the solution 15 has strong acidity (or strong alkalinity), the solution 15 is prevented from being exposed directly to the ultrasonic oscillators 2, thus allowing for the efficient propagation of the oscillation energy to the solution 15 in the separator 8.

The atomizing apparatus 100 according to the present embodiment may include the plurality of ultrasonic oscillators 2 located therein. This configuration allows the solution 15 to be formed into a mist more efficiently.

An experiment was carried out to verify the effects for the case where the plurality of ultrasonic oscillators 2 are provided. The results of this experiment are shown in FIG. 10.

Figure 10:
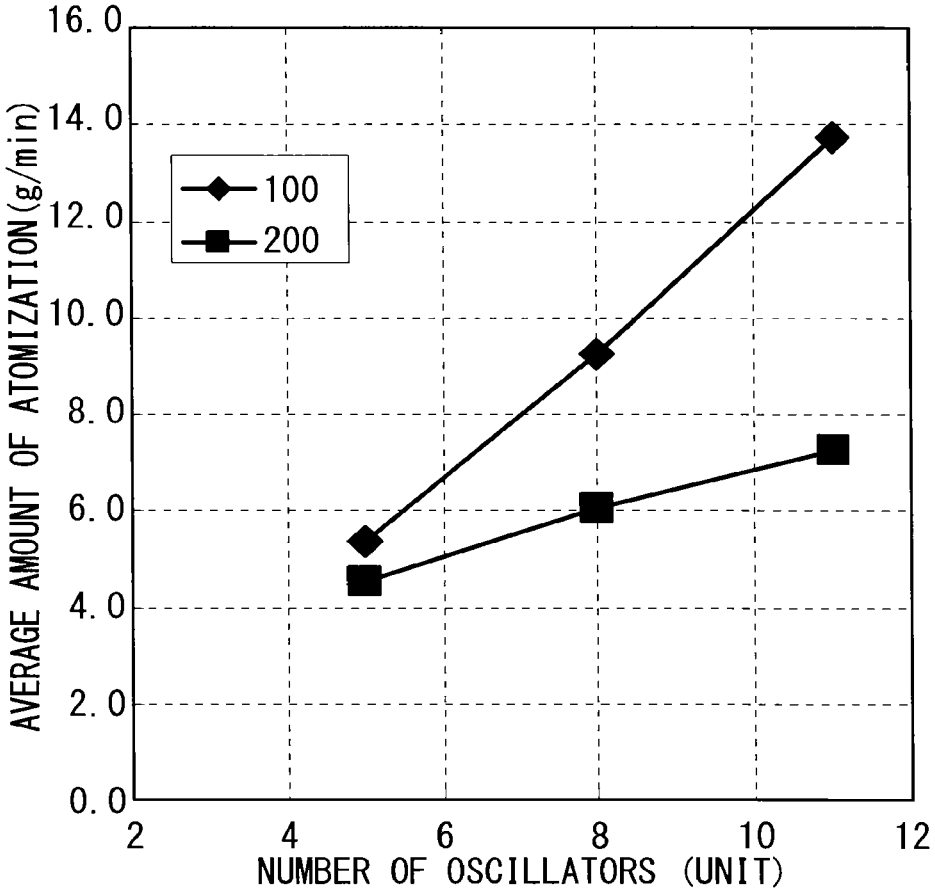
FIG. 10 A view illustrating experimental data for describing effects of the present invention obtained by including the plurality of ultrasonic oscillators 2.

FIG. 10 shows the experimental results indicating the relation between the number of ultrasonic oscillators 2 and the amount of the misted solution 7 (hereinafter referred to as mist). The vertical axis in FIG. 10 indicates the average amount of atomization (g (gram)/min (minute)) and the horizontal axis in FIG. 10 indicates the number (unit) of the included ultrasonic oscillators 2. With reference to FIG. 10, the black rhombus marks indicate the results involved in the atomizing apparatus 100 illustrated in FIG. 1 and the black square marks indicate the results involved in the comparison target atomizing apparatus 200 illustrated in FIG. 9. Although having some differences in configuration as described with reference to FIG. 9, the atomizing apparatuses 100 and 200 have, for example, the same operating conditions for the implementation of the experimental data shown in FIG. 10.

In the experiment indicated in FIG. 10, the number of the ultrasonic oscillators 2 included in the atomizing apparatuses 100 and 200 was changed, and then, the average amount of atomization was measured as described with reference to FIG. 8.

As is evident form the experimental results indicated in FIG. 10, the atomizing apparatus 100 according to the present embodiment can produce the misted solution 7 more efficiently than the comparison target atomizing apparatus 200 along with increasing number of the ultrasonic oscillators 2. The inclusion of the plurality of ultrasonic oscillators 2 in the atomizing apparatus 100 unexpectedly yields the significant improvement of the atomizing apparatus 100 in the efficiency of mist generation.

In a case where the plurality of ultrasonic oscillators 2 are located on the bottom surface of the container 1, the oscillation planes of the ultrasonic oscillators 2 are inclined to the liquid surface of the solution 15 (see FIG. 6). It is desirable that each of the ultrasonic oscillators 2 is not located in the lower position onto which liquid droplets from the liquid column 6 of the solution 15 formed by another one of the ultrasonic oscillators 2 fall. For example, the plurality of ultrasonic oscillators 2 are located on the bottom surface of the container 1 in an annular shape and the oscillation planes of the individual ultrasonic oscillators 2 are inclined toward the center of the annular shape (see FIG. 7).

The above-mentioned configuration allows the atomizing apparatus 100 including the plurality of ultrasonic oscillators 2 to form the solution 15 into a mist more efficiently.

The atomizing apparatus 100 according to the present embodiment may include the liquid surface position detection sensor 10 and the solution supplying unit 11. The solution supplying unit 11 may supply the solution 15 into the container 1 such that the level of the liquid surface 15A detected by the liquid surface position detection sensor 10 reaches the predetermined position determined in advance (the level of the liquid surface 15A for maximizing the efficiency of mist generation).

This configuration allows the atomizing apparatus 100 according to the present embodiment to maintain the amount of the solution 15 (the level of the liquid surface 15A) accommodated in the container 1 at the position for maximizing the efficiency of mist generation. Thus, the atomizing apparatus 100 is capable of continuously generating a mist for a long period of time with the excellent efficiency of mist generation.

While the invention has been shown and described in detail, the foregoing description is in all aspects illustrative and not restrictive. It is therefore understood that numerous modifications and variations can be devised without departing from the scope of the invention.

The invention claimed is:

1. An atomizing apparatus that forms a solution into a mist, said atomizing apparatus comprising:
- a container that accommodates said solution;
- a mist generator that forms said solution into a mist;
- an inner hollow structure that is located in said container and has a hollow inside;
- a gas supplying unit that is located in said container and supplies a gas into a gas supply space being a space enclosed by an inner surface of said container and an outer surface of said inner hollow structure; and
- a connecting portion that connects said hollow of said inner hollow structure and said gas supply space,
- wherein a speed of the gas output from the connecting portion into said hollow of said inner hollow structure is faster than a speed of the carrier gas output from the gas supplying unit into said gas supply space,
- the gas supplying unit includes a single gas supply port through which the gas enters into the gas supply space, and
- wherein a dimension between an inner wall surface of said container and an outer wall surface of said inner hollow structure in said gas supply space around said connecting portion is smaller than a dimension between the inner wall surface of said container and the outer wall surface of said inner hollow structure in said gas supply space around said gas supplying unit.

2. The atomizing apparatus according to claim 1, wherein said connecting portion is drilled or cut out in a side surface portion of said inner hollow structure.

3. The atomizing apparatus according to claim 1, wherein a part of said connecting portion is defined by an end portion of said inner hollow structure.

4. The atomizing apparatus according to claim 1, wherein an opening area of an opening of said connecting portion is smaller than an opening area of a supply port of said gas supplying unit.

5. The atomizing apparatus according to claim 1, wherein the supply port of said gas supplying unit does not directly face said gas supply space facing said connecting portion.

6. The atomizing apparatus according to claim 1, wherein
- said mist generator comprises an ultrasonic oscillator that applies ultrasonic waves to said solution, said ultrasonic oscillator being located on a bottom surface of said container,
- said atomizing apparatus further comprises:
  - a separator located between said bottom surface of said container and an end portion side of said inner hollow structure; and
  - an ultrasonic wave transmitting medium accommodated in a space formed between said container and said separator, and
- said solution resides on an upper surface of said separator.

7. The atomizing apparatus according to claim 6, wherein said ultrasonic oscillator comprises a plurality of ultrasonic oscillators.

8. The atomizing apparatus according to claim 7, wherein
- said plurality of ultrasonic oscillators are located on the bottom surface of said container,
- oscillation planes of said plurality of ultrasonic oscillators are inclined to a liquid surface of said solution, and
- each of said plurality of ultrasonic oscillators is not located in a lower position onto which liquid droplets from a liquid column of said solution formed by another one of said plurality of ultrasonic oscillators fall.

9. The atomizing apparatus according to claim 8, wherein
- said plurality of ultrasonic oscillators are located on said bottom surface of said container in an annular shape, and
- said oscillation planes of said plurality of ultrasonic oscillators are inclined toward a center of said annular shape.

10. The atomizing apparatus according to claim 1, further comprising a liquid surface position detection sensor that detects a level position of a liquid surface of said solution.

11. The atomizing apparatus according to claim 10, further comprising a solution supplying unit that supplies said solution into said container,
- wherein said solution supplying unit supplies said solution into said container such that said level position of said liquid surface of said solution detected by said liquid surface position detection sensor reaches a predetermined position determined in advance.

12. The atomizing apparatus according to claim 1, wherein said gas is a highly concentrated inert gas.

13. An atomizing apparatus that forms a solution into a mist, said atomizing apparatus comprising:
- a container that accommodates said solution;
- a mist generator that forms said solution into a mist;
- an inner hollow structure that is located in said container and has a hollow inside;
- a gas supplying unit that is located in said container and supplies a gas into a gas supply space being a space enclosed by an inner surface of said container and an outer surface of said inner hollow structure; and a connecting portion that connects said hollow of said inner hollow structure and said gas supply space, wherein a speed of the gas output from the connecting portion into said hollow of said inner hollow structure is faster than a speed of the carrier gas output from the gas supplying unit into said gas supply space, wherein the gas supplying unit is located on the upper surface of the container, and wherein a dimension between an inner wall surface of said container and an outer wall surface of said inner hollow structure in said gas supply space around said connecting portion is smaller than a dimension between the inner wall surface of said container and the outer wall surface of said inner hollow structure in said gas supply space around said gas supplying unit.

* * * * *